US011466445B2

(12) United States Patent
Wong et al.

(10) Patent No.: US 11,466,445 B2
(45) Date of Patent: Oct. 11, 2022

(54) INTEGRATED STEEL CONCRETE BUILDING AND CONSTRUCTION METHOD THEREOF

(71) Applicant: Yau Lee Wah Construction Materials (Huizhou) Company Limited, Huizhou (CN)

(72) Inventors: Conrad Tin Cheung Wong, Shenzhen (CN); Rosana Wai Man Wong, Shenzhen (CN)

(73) Assignee: Yau Lee Wah Construction Materials (Huizhou) Company Limited, Huizhou (CN)

( * ) Notice: Subject to any disclaimer, the term of this patent is extended or adjusted under 35 U.S.C. 154(b) by 150 days.

(21) Appl. No.: 17/007,638

(22) Filed: Aug. 31, 2020

(65) Prior Publication Data

US 2021/0348379 A1 Nov. 11, 2021

(30) Foreign Application Priority Data

May 6, 2020 (CN) ..... 202010372191.X

(51) Int. Cl.
*E04B 1/348* (2006.01)
*E04B 1/35* (2006.01)
(Continued)

(52) U.S. Cl.
CPC ..... *E04B 1/34807* (2013.01); *E04B 1/3505* (2013.01); *E04B 1/948* (2013.01);
(Continued)

(58) Field of Classification Search
CPC .... E04B 1/34807; E04B 1/3505; E04B 1/948; E04B 2103/02; E04B 1/3483; E04B 1/348; E04C 5/01; E04G 11/02
See application file for complete search history.

(56) References Cited

U.S. PATENT DOCUMENTS 3,940,890 A * 3/1976 Postlethwaite ..... E04B 1/34815 52/263
4,545,159 A * 10/1985 Rizk ..... E04B 1/3483 52/79.9

(Continued)

FOREIGN PATENT DOCUMENTS

EP 2646632 A1 10/2013
GB 2362659 A * 11/2001 ..... E04B 1/34823
WO 2017116305 A1 7/2017

OTHER PUBLICATIONS

European Patent Office, Extended European Search Report, Application No. 20190403.4, dated Jan. 12, 2021, 7 pages.

*Primary Examiner* — Gisele D Ford
(74) *Attorney, Agent, or Firm* — Ziegler IP Law Group, LLC

(57) ABSTRACT

The present invention discloses an integrated steel concrete building and its construction method. The building comprises a plurality of prefabricated room modules of steel, each including at least one column having a structure of hollow steel tube, which has an inner chamber inserted with penetrating rebars and poured with concrete. The penetrating rebars extend upwardly out of the column of the prefabricated room module into an inner chamber of a column of a prefabricated room module of an upper floor.

13 Claims, 15 Drawing Sheets

(51) Int. Cl.
*E04B 1/94* (2006.01)
*E04C 5/01* (2006.01)
*E04G 11/02* (2006.01)

(52) U.S. Cl.
CPC ..... *E04C 5/01* (2013.01); *E04G 11/02* (2013.01); *E04B 2103/02* (2013.01)

(56) References Cited

U.S. PATENT DOCUMENTS 4,545,169 A * 10/1985 Rizk ..... E04B 1/3483 52/234
4,833,841 A * 5/1989 Ellington, III ..... E04B 1/3483 52/690
5,755,063 A * 5/1998 Ohnishi ..... E04B 1/3483 52/79.8
11,276,323 B1 * 3/2022 Kirchner ..... E04B 1/2403
2011/0252718 A1 * 10/2011 Kobayashi ..... E04B 1/3483 52/745.2
2012/0240482 A1 * 9/2012 Pitt ..... B66C 1/66 52/745.03
2014/0298745 A1 * 10/2014 Rechenmacher ..... E04G 21/02 52/425
2016/0017599 A1 * 1/2016 Klein ..... E04B 2/7411 52/717.03
2016/0222649 A1 * 8/2016 Baik ..... E04H 1/005
2018/0238770 A1 * 8/2018 Annunen ..... E04B 1/941
2019/0040621 A1 * 2/2019 Dooley ..... E04B 1/215
2019/0048575 A1 * 2/2019 Wong ..... E04B 1/34
2019/0144081 A1 * 5/2019 Llago Hermida ..... B63B 73/40 114/71
2019/0234063 A1 * 8/2019 Garcia-Abril Ruiz .... E06B 9/02
2019/0257070 A1 * 8/2019 Grosch ..... E04B 1/5831
2020/0011076 A1 * 1/2020 Wong ..... E04B 1/34807
2020/0095758 A1 * 3/2020 Wong ..... E04B 1/34807
2020/0190788 A1 * 6/2020 Binder ..... E04B 1/40
2020/0208395 A1 * 7/2020 Hall ..... E04B 1/19
2021/0062495 A1 * 3/2021 Ligeti ..... E04B 1/40
2021/0123229 A1 * 4/2021 O'Brien ..... E04B 1/3483
2021/0172164 A1 * 6/2021 Holm ..... E04H 1/04
2021/0324644 A1 * 10/2021 Dicks ..... E04H 1/02
2022/0010543 A1 * 1/2022 Pitt ..... E04B 1/34869
2022/0018112 A1 * 1/2022 Isaacs ..... E04B 1/165

* cited by examiner

INTEGRATED STEEL CONCRETE BUILDING AND CONSTRUCTION METHOD THEREOF

FIELD OF THE INVENTION

The present invention relates to a building structure and its construction method, and more particularly, to an integrated concrete building having prefabricated room modules of steel, and a construction method thereof.

BACKGROUND OF THE INVENTION

Traditional residential or office buildings are generally built through in-situ casting concrete at the construction site. However, the construction of such traditional cast-in-situ buildings not only suffers disadvantages such as complicated construction steps, long construction period, intensive labor consumption and hardly controlled quality, but also brings about a large amount of construction rubbish and generates heavy noise and dust pollution, causing great disturbance on daily life of surrounding residents.

To this end, the construction of current buildings gradually adopts prefabricated building modules, such as prefabricated kitchens, prefabricated bathrooms, prefabricated bedrooms, and so on, which have been completed at respective factories in advance, and then assembled together at the construction site. This kind of construction can essentially reduce on-site workload, shorten the construction duration, and cut down labor cost. In addition, the disturbance on surrounding residents can be greatly reduced also.

In current prefabricated room modules of steel, steel members are connected with each other by bolts or welds during construction. Therefore, protruding bolts or welded projections will be present on outer surfaces of the steel members, so that these outer surfaces will have no smooth and beautiful appearance. In addition, regular maintenance and inspection of bolted or welded connections of the steel members are required. Moreover, prefabricated room modules of steel generally have poor thermal insulation and fire resistance, which will affect the residents' living experience.

SUMMARY OF THE INVENTION

In order to solve the above technical problem, the present invention provides an integrated steel concrete building, which can be assembled without bolts or welds. The present invention further provides a construction method thereof.

The present invention provides an integrated steel concrete building, comprising a plurality of prefabricated room modules of steel. Each prefabricated room module includes at least one column having a structure of hollow steel tube, which has an inner chamber inserted with penetrating rebars and poured with concrete. The penetrating rebars extend upwardly out of said column of said prefabricated room module into an inner chamber of a column of a prefabricated room module of an upper floor.

In an embodiment, adjacent columns of adjacent prefabricated room modules of a same floor are connected with each other through bolts at respective top portions of said adjacent columns.

In an embodiment, each prefabricated room module includes a steel structure frame and a steel concrete bottom plate. The bottom plate is provided with a base beam extending downwardly, so that a fireproof cavity is formed between two vertically adjacent prefabricated room modules.

In an embodiment, each prefabricated room module further includes a steel concrete top plate, which is provided on its top surface with a boss extending upwardly. The boss is located at a position corresponding to the base beam of the prefabricated room module of said upper floor.

In an embodiment, each prefabricated room module further includes fireproof wall bodies.

In an embodiment, a gasket is interposed between columns of two vertically adjacent prefabricated room modules, and is provided with through-holes, through which the penetrating rebars can extend.

In an embodiment, a top joint formed between two horizontally adjacent prefabricated room modules is filled with fireproof sealant.

In an embodiment, the integrated steel concrete building further comprises prefabricated walkway plates and cast-in-situ concrete structural members.

The present invention further provides a construction method of the integrated steel concrete building as mentioned above, including:

step A, hoisting, after an $N^{th}$ floor of the building is completed, the prefabricated room module to a predetermined position on an $(N+1)^{th}$ floor;

step B, inserting the penetrating rebars protruding out of the top portion of the column of the prefabricated room module of the $N^{th}$ floor into the inner chamber of the column of the prefabricated room module of the $(N+1)^{th}$ floor;

step C, connecting adjacent columns of adjacent prefabricated room modules of the $(N+1)^{th}$ floor with each other through bolts at the top portions of said adjacent columns; and step D, pouring cement mortar in the inner chamber of the column of the prefabricated room module of the $(N+1)^{th}$ floor.

In an embodiment, the method further comprises, before step A, step A1 of forming a cast-in-situ concrete structure on the $(N+1)^{th}$ floor.

In an embodiment, the method further comprises, before step A, step A2 of filling fireproof sealant in a top joint between two adjacent prefabricated room modules of the $N^{th}$ floor.

In an embodiment, the method further comprises, before step A, step A3 of placing a gasket on the top portion of the column of the prefabricated room module of the $N^{th}$ floor, and step A4 of providing a cement mortar cushion layer at a periphery of the top portion of the prefabricated room module of the $N^{th}$ floor.

In an embodiment, the method further comprises, after step D, step E of placing a prefabricated walkway plate of an $(N+2)^{th}$ floor.

Compared with the prior arts, the integrated steel concrete building according to the present invention has the following advantages.

1. The building is mainly formed by assembling prefabricated room modules together, which are prefabricated in respective factories. The interior decoration can be completed in advance, and various devices can be also preinstalled. In this manner, advantages such as uniform quality, high efficiency, low cost, and excellent thermal/sound insulation performances can be obtained. Accordingly, construction steps that are necessary to be performed at the construction site can be greatly reduced, and in the meantime, influences of weather conditions, labor resources, construction site restrictions or the like on the construction procedure can be also mitigated.

2. Adjacent prefabricated room modules can be connected with each other through rebars and grouting in the inner chambers of columns. Except that the top portions of horizontally adjacent columns have to be connected with each other with bolts, steel members can be connected without bolts or welds. Accordingly, surface smoothness of prefabricated room modules can be maximized, and maintenance and inspection of bolts or welds are unnecessary.

3. A fireproof cavity is formed between two prefabricated room modules vertically adjacent to each other, thus providing excellent fireproof performances. Therefore, a large amount of fireproof materials, such as fireproof board, fireproof glue, etc., can be saved, which is beneficial to fire prevention and cost reduction.

4. The present invention can also bring about advantages of engineering quality control, long distance transportation of large components, project planning, and construction period control, etc.

DETAILED DESCRIPTION OF THE EMBODIMENTS

In the following, the embodiments of the present invention will be further illustrated with reference to the appending drawings.

Figure 1:
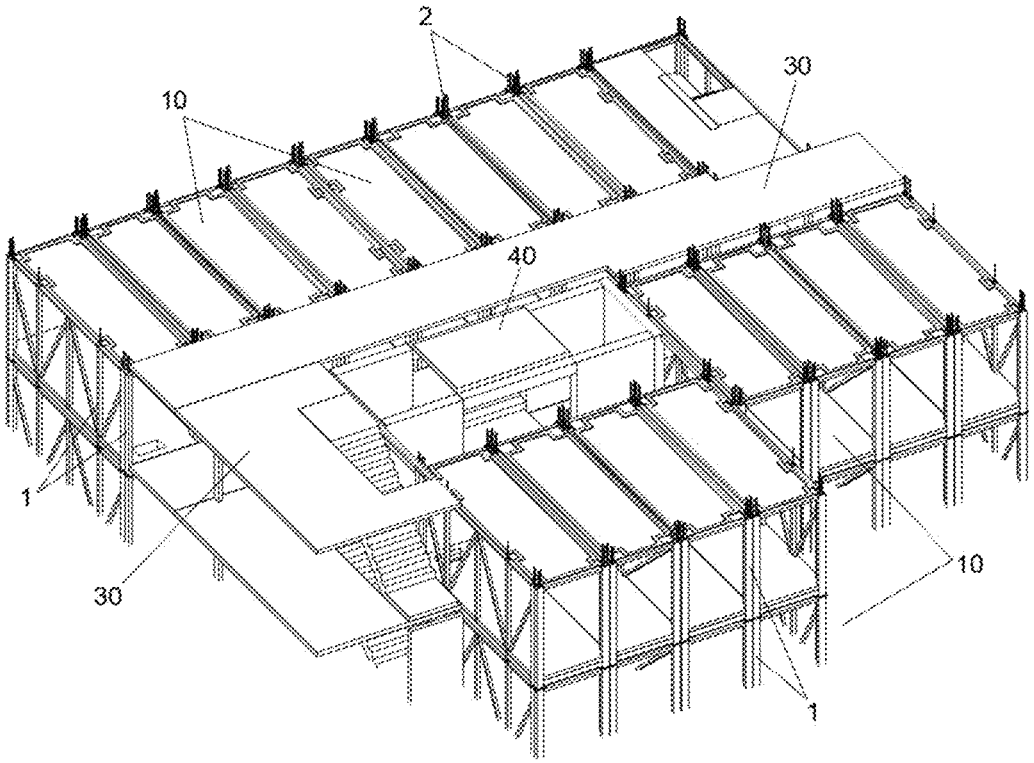
FIG. 1 schematically shows the structure of an integrated steel concrete building according to the present invention.

As shown in FIG. 1, an integrated steel concrete building according to the present invention is mainly formed by assembling a plurality of prefabricated room modules 10 of steel together. The integrated steel concrete building can further include other prefabricated components, such as prefabricated walkway plates 30, prefabricated walls, prefabricated stairs, or the like. According to specific design needs, cast-in-situ concrete structural members 40 can be also provided at some particular locations of the building, such as the lift well.

Figure 2:
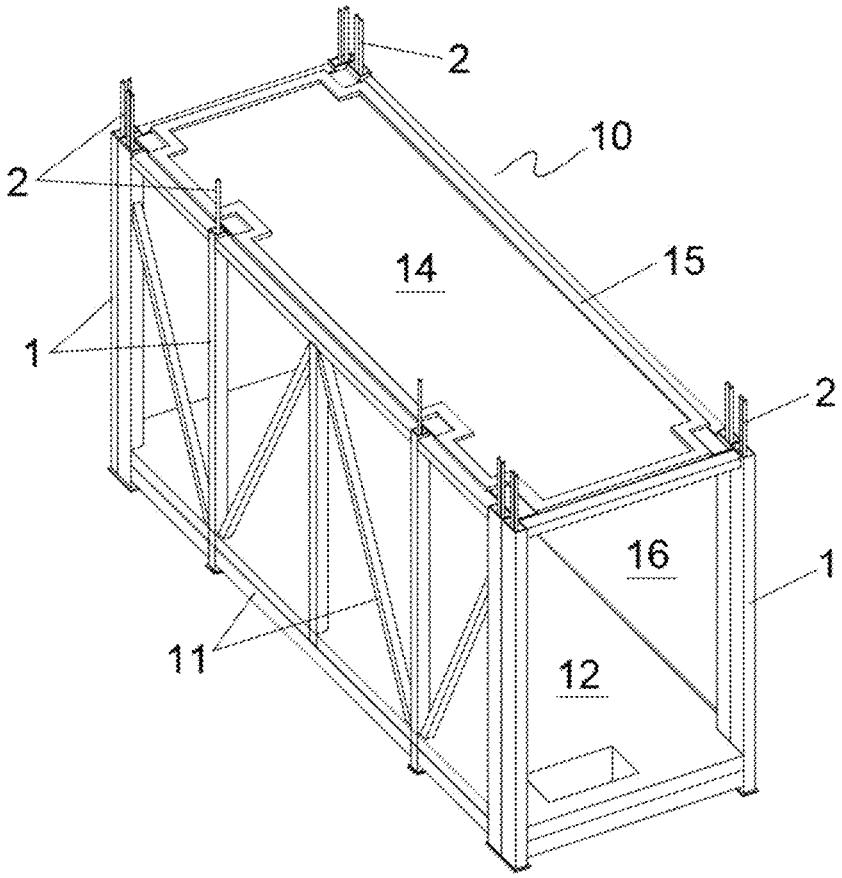
FIG. 2 is a schematic perspective view of a prefabricated room module.

As shown in FIG. 2, each prefabricated room module 10 is a self-contained component that has been prefabricated at a respective factory in advance, and usually has a square shape. The prefabricated room module 10 comprises a steel structure frame 11, a reinforced concrete bottom plate 12, a reinforced concrete top plate 14, and wall bodies 16. Of course, the prefabricated room module 10 can also be designed into other shapes according to design needs. Alternatively, doors and/or windows can be formed on one or more wall bodies of one or more of the prefabricated room modules, or one or more prefabricated room modules may not be provided with the top plate, the bottom plate, or one of the wall bodies. Moreover, the top plate and the bottom plate can be embedded with various lines or boxes in advance, and the interior decoration of the prefabricated room module 10 may be completed in advance and various devices may be pre-installed, in order to minimize the on-site construction duration. Among others, the steel structure frame 11 is formed by assembling steel profiles, and columns 1 are provided at the periphery of the steel structure frame 11, especially at four corners thereof, each column 1 having a structure of hollow steel tube.

Figure 5:
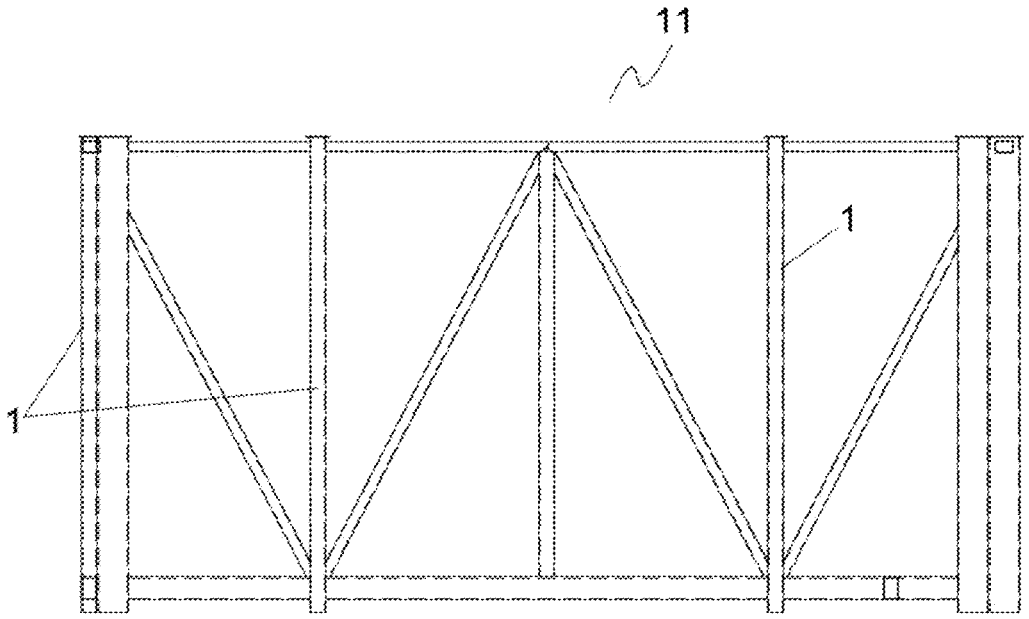
FIG. 5 schematically shows step 1 of construction of the prefabricated room module.
Figure 6:
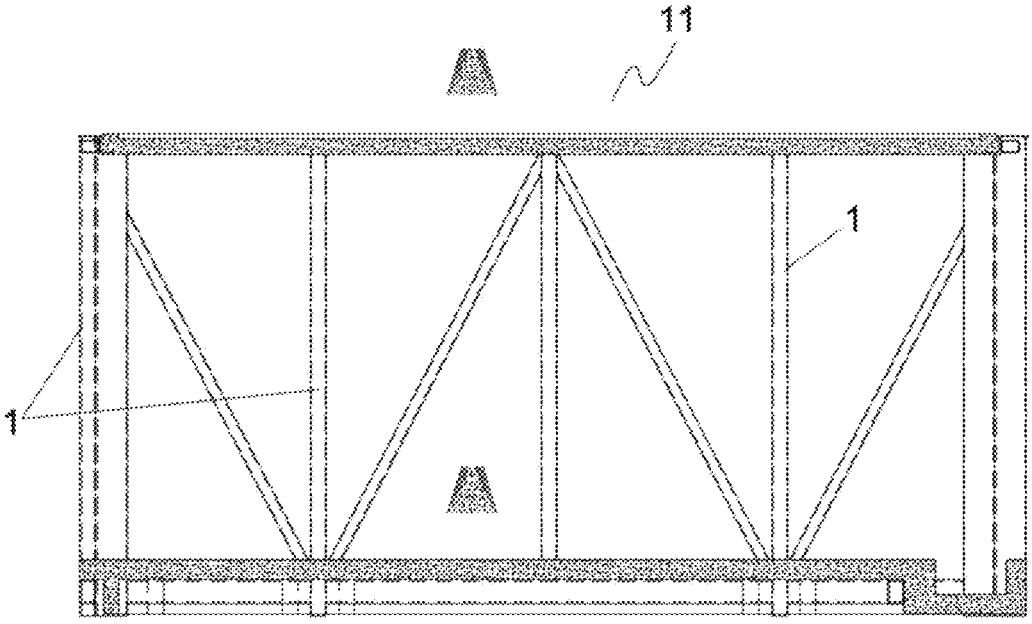
FIG. 6 schematically shows step 2 of construction of the prefabricated room module.
Figure 7:
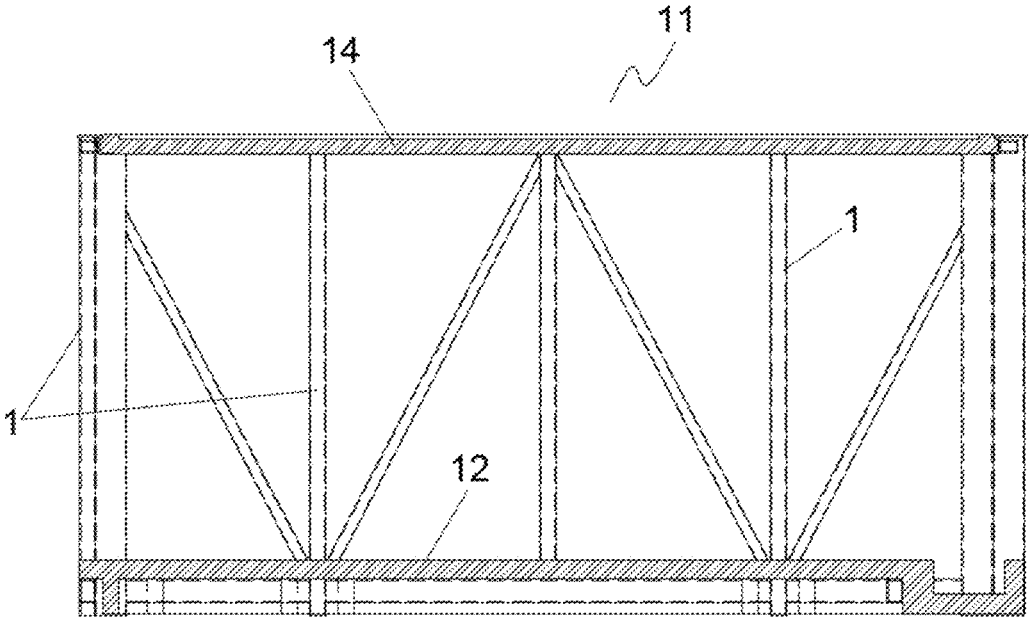
FIG. 7 schematically shows step 3 of construction of the prefabricated room module.

The prefabricated room module 10 is generally manufactured with the following steps. In step 1, as shown in FIG. 5, the steel structure frame 11 is formed by assembling steel profiles. In step 2, as shown in FIG. 6, steel molds for the top and bottom plates respectively are assembled, rebars of the top and bottom plates are fixed and bundled, pre-embedded members are mounted, and then concrete are cast for the top and bottom plates. In step 3, as shown in FIG. 7, wall bodies of the periphery wall and the inner partition wall of the prefabricated room module 10 are assembled, wherein the wall bodies may be formed with fireproof materials, in order to enhance the fireproof performance of the building.

Figure 3:
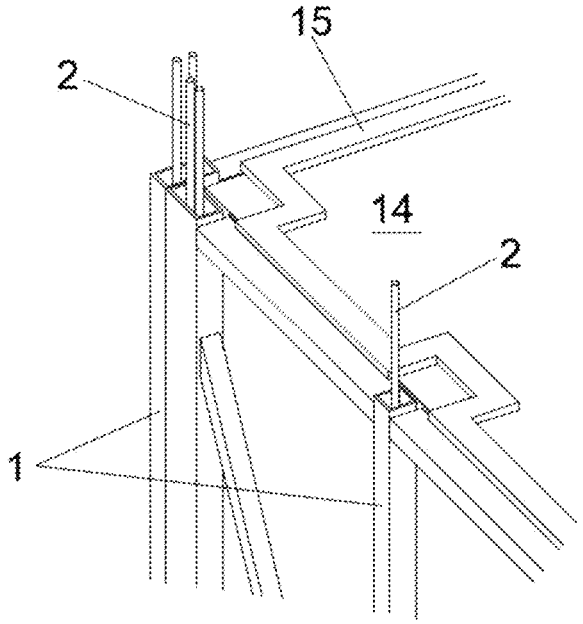
FIG. 3 is an enlarged view of a column of the prefabricated room module.
Figure 16:
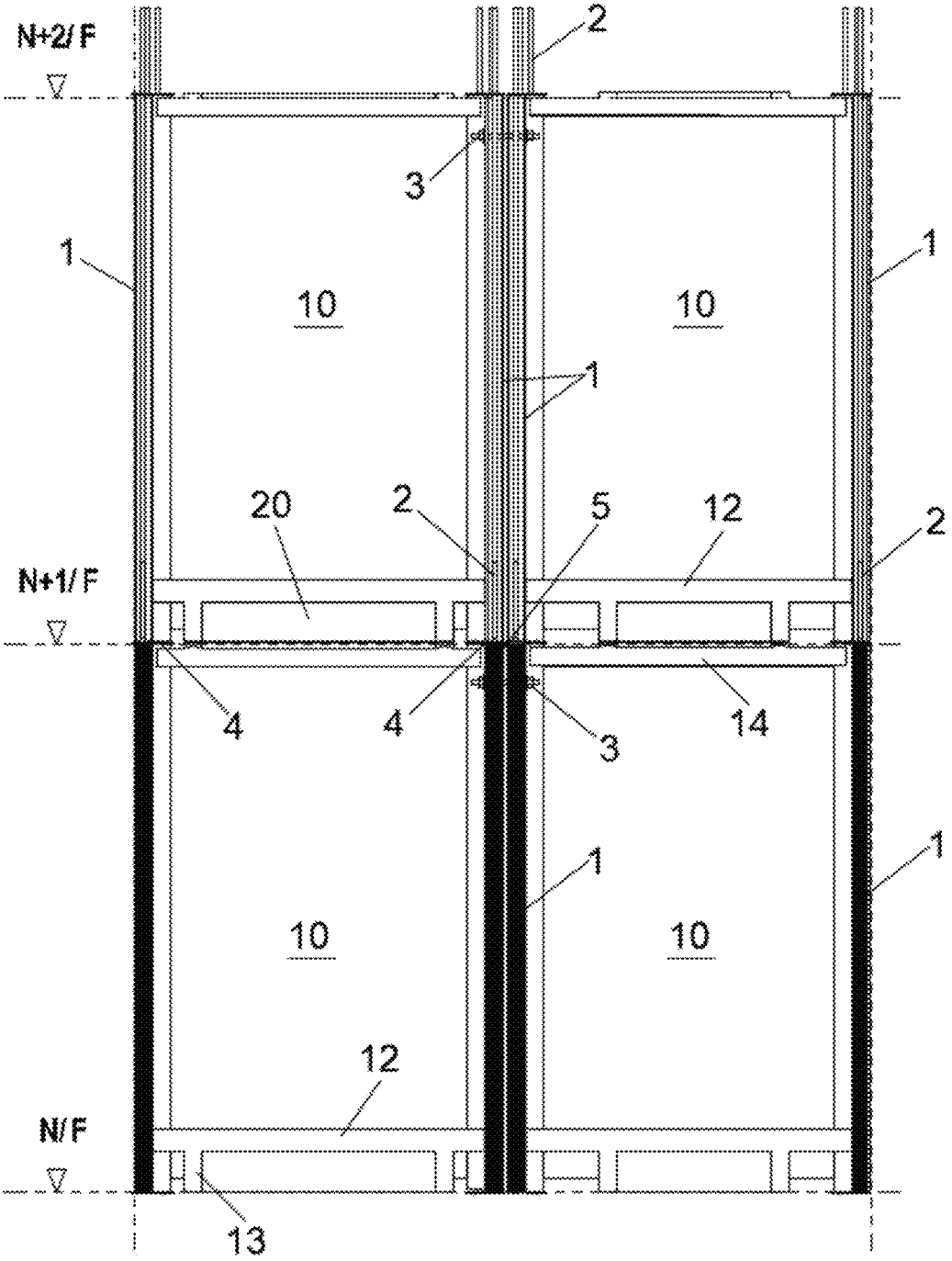
FIG. 16 schematically shows a vertical cross-sectional view for step 6 of the construction method for the integrated steel concrete building according to the present invention.
Figure 19:
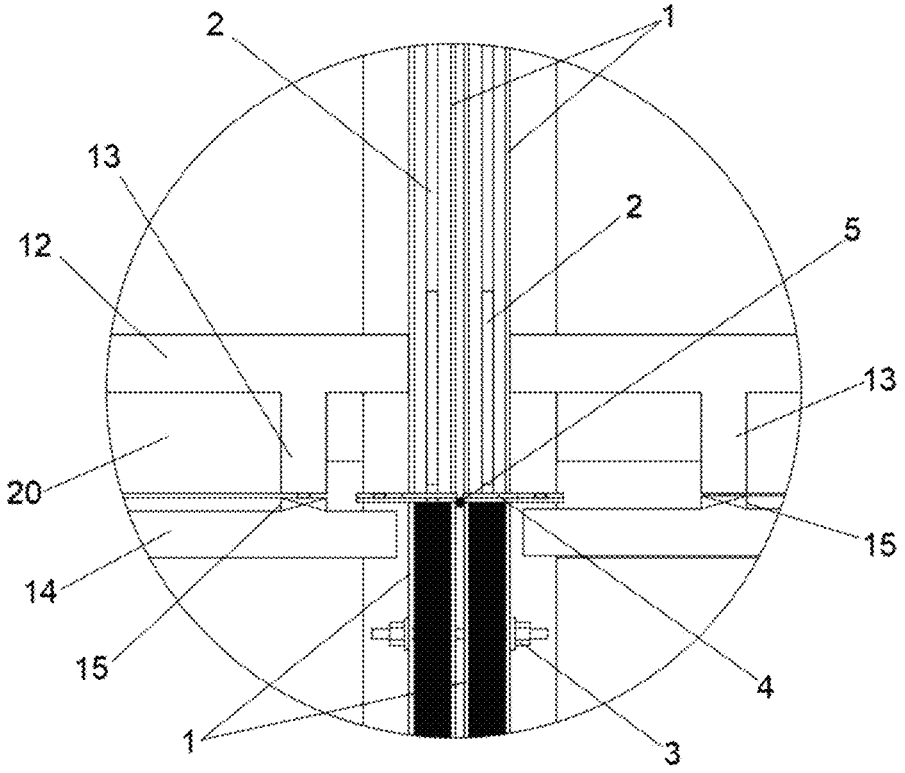
FIG. 19 is an enlarged view of the connection area of the columns of two vertically adjacent prefabricated room modules as shown in FIG. 14.

When the prefabricated room module 10 is assembled at the construction site, as shown in FIGS. 3 and 19, penetrating rebars 2 are inserted into an inner chamber of the column 1 of the prefabricated room module 10, and then concrete is poured therein. The top portion of each penetrating rebar 2 extends vertically out of the column 1 of the prefabricated room module 10 into the inner chamber of the column 1 of the prefabricated room module 10 of an upper floor. In this manner, two vertically adjacent prefabricated room modules 10 are connected with each other through the penetrating rebars 2 and concrete, thus no bolts or welds are necessary for connecting adjacent steel members. Accordingly, surface smoothness of the prefabricated room modules 10 can be maximized, and maintenance and inspection of bolts or welds are unnecessary. Further, as shown in FIG. 16, the top portions of adjacent columns 1 of two horizontally adjacent prefabricated room modules 10 of the same floor are connected together by penetrating bolts, thus realizing connection of the prefabricated room modules 10 along the horizontal direction.

Figure 4:
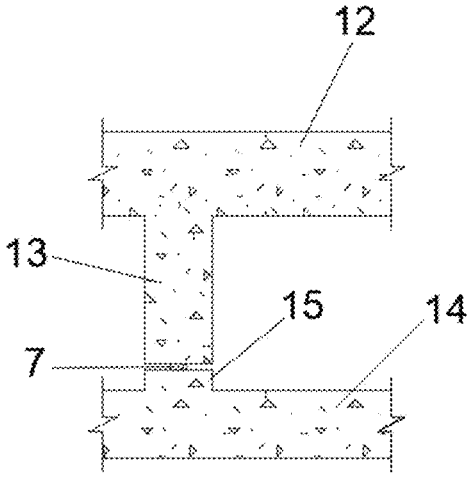
FIG. 4 schematically shows the connection between a concrete top plate and a concrete bottom plate of two vertically adjacent prefabricated room modules.

As shown in FIGS. 4 and 19, the reinforcing concrete bottom plate 12 is provided with a base beam 13 protruding downwardly at a position adjacent to the periphery thereof, and the top surface of the reinforcing concrete top plate 14 is provided with a boss 15 protruding upwardly, wherein the boss 15 is located at a position corresponding to the base beam 13 of the prefabricated room module 10 of an upper floor. In this manner, a fireproof cavity 20 is formed between two vertically adjacent prefabricated room modules 10 after assembly. Thus the fireproof performance of the building can be improved, and in the meantime a large amount of fireproof materials, such as fireproof boards, fireproof glue, etc., can be reduced, thus enhancing fireproof and saving cost. In addition, a top joint formed between two horizontally adjacent prefabricated room modules 10 is filled with fireproof sealant 5, which can further enhance the fireproof performance.

Moreover, in order to facilitate grouting in the inner chamber of the column 1 and also take installation error between the vertically adjacent prefabricated room modules 10 into account, a gasket 4 is interposed between columns 1 of two vertically adjacent prefabricated room modules 10. The gasket 4 is provided with through-holes, through which the penetrating rebars 2 can extend.

In one embodiment, the construction method of the integrated steel concrete building according to the present invention includes the following steps.

Figure 8:
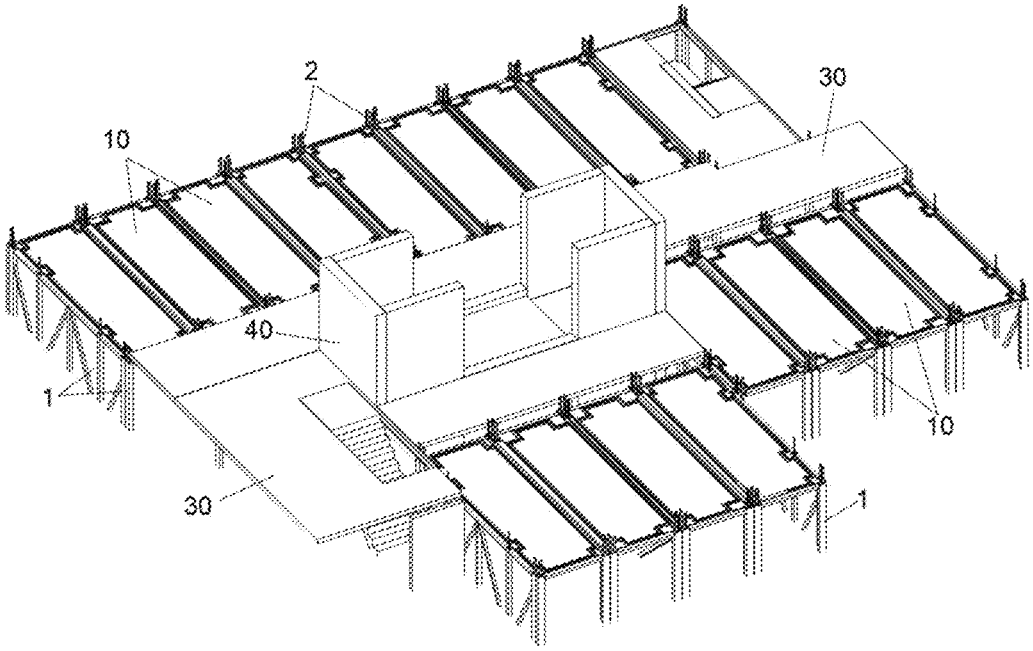
FIG. 8 schematically shows a perspective view for step 1 of the construction method for the integrated steel concrete building according to the present invention.

Step 1. As shown in FIG. 8, after an $N^{th}$ floor of the building is completed, a cast-in-situ concrete structure 40, such as a concrete main wall, is constructed on an $(N+1)^{th}$ floor.

Figure 9:
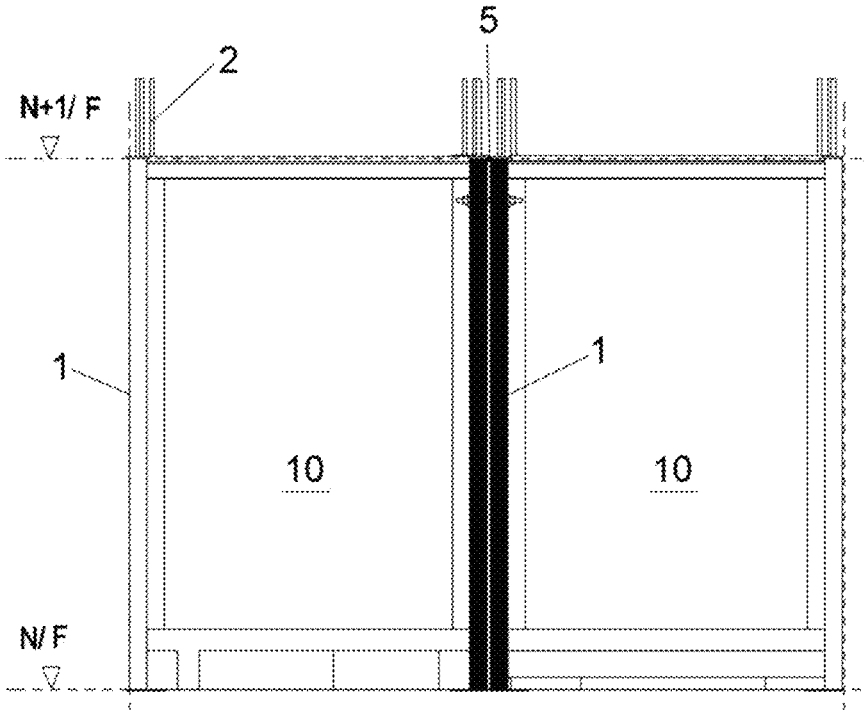
FIG. 9 schematically shows a vertical cross-sectional view for step 2 of the construction method for the integrated steel concrete building according to the present invention.
Figure 10:
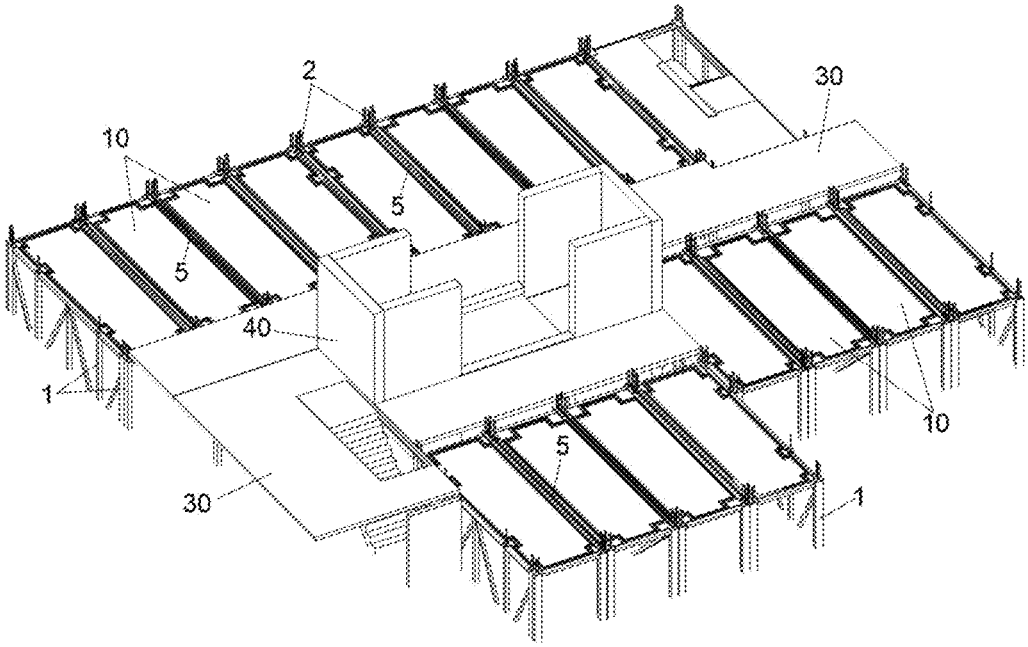
FIG. 10 schematically shows a perspective view for step 2 of the construction method for the integrated steel concrete building according to the present invention.

Step 2. As shown in FIGS. 9 and 10, the fireproof sealant 5 is filled in the top joint between two adjacent prefabricated room modules 10 of the $N^{th}$ floor.

Figure 11:
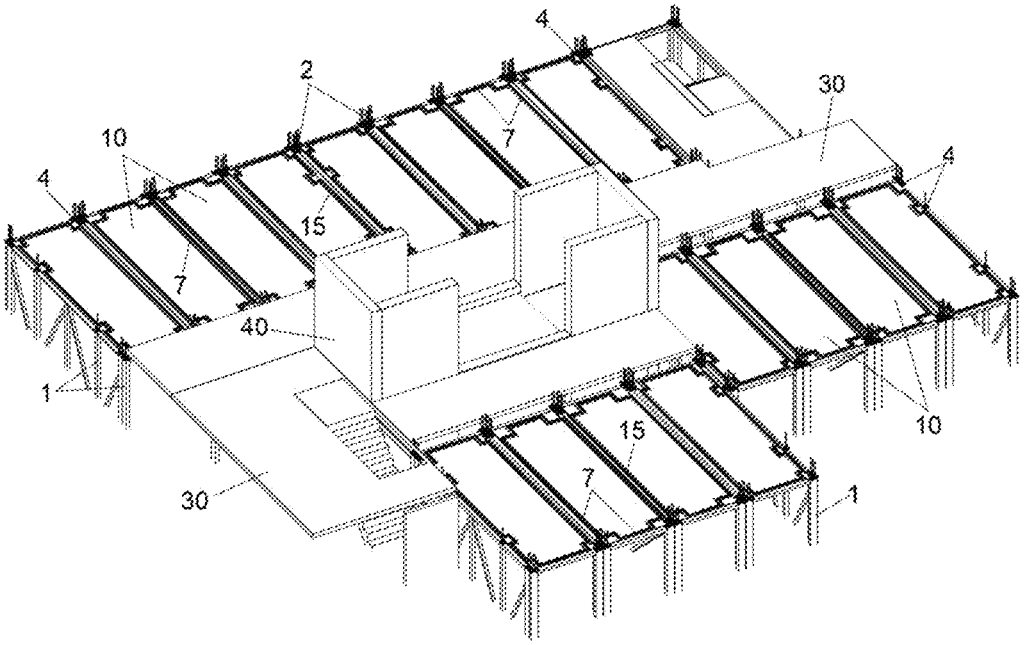
FIG. 11 schematically shows a perspective view for step 3 of the construction method for the integrated steel concrete building according to the present invention.

Step 3. As shown in FIG. 11, the gasket 4 is placed on the top portion of each column 1 of the prefabricated room module 10 of the $N^{th}$ floor, for subsequent grouting.

Step 4. As shown in FIG. 11, a cement mortar cushion layer 7 is provided on the top surface of the boss 15 at the periphery of the top portion of the prefabricated room module 10 of the $N^{th}$ floor.

Figure 12:
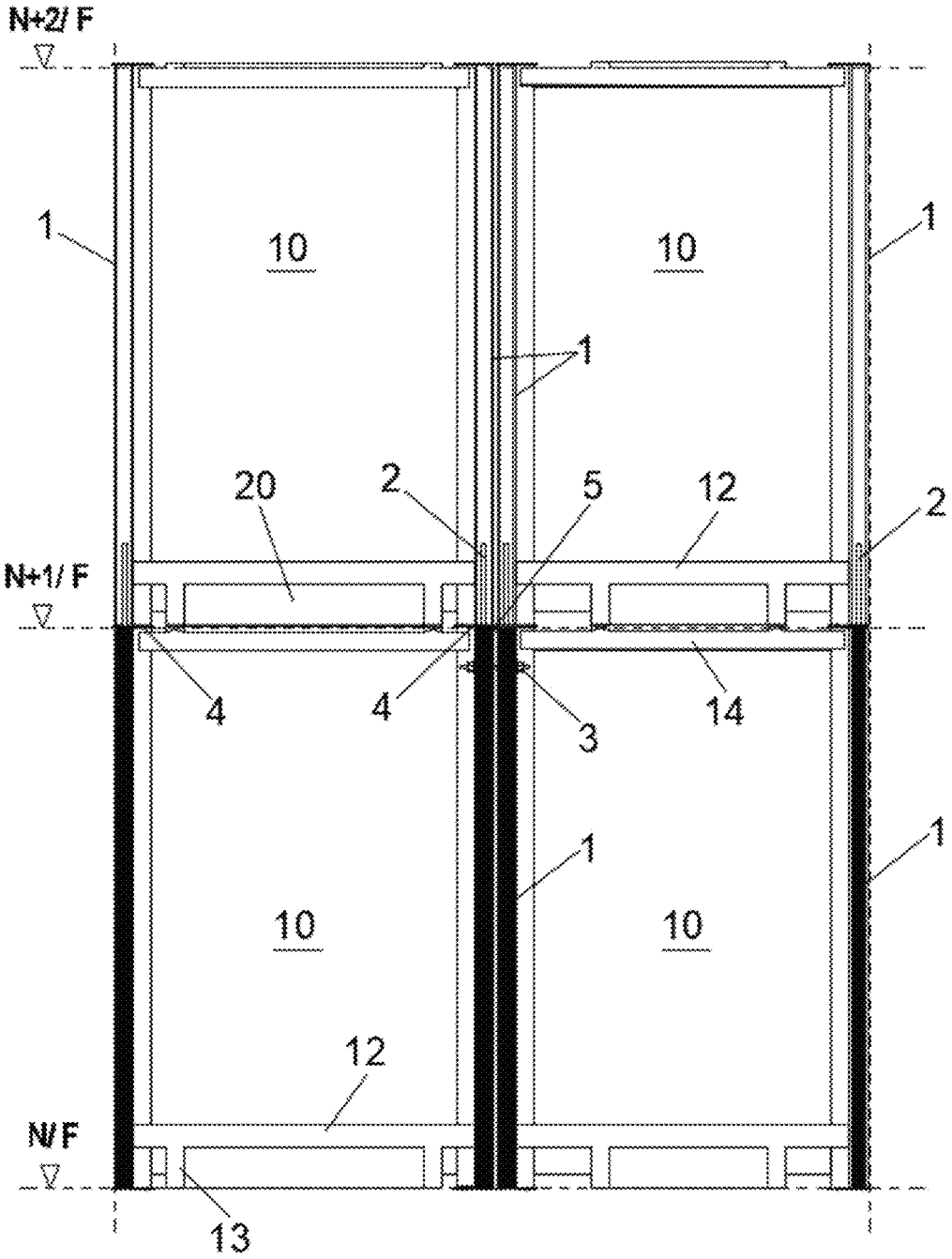
FIG. 12 schematically shows a vertical cross-sectional view for step 4 of the construction method for the integrated steel concrete building according to the present invention.
Figure 13:
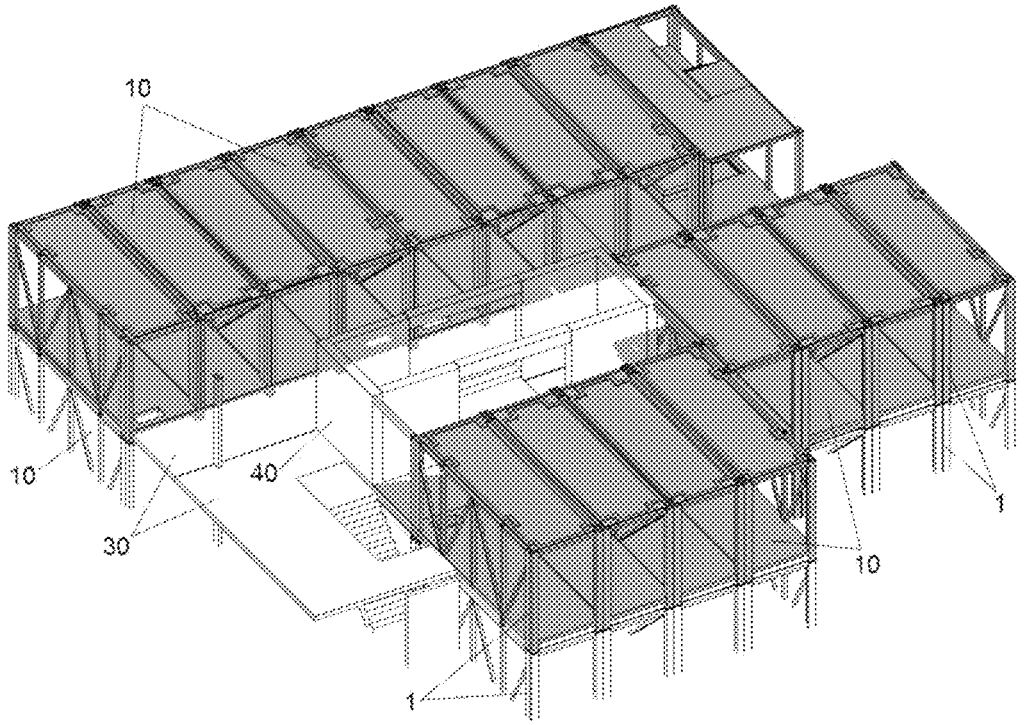
FIG. 13 schematically shows a perspective view for step 4 of the construction method for the integrated steel concrete building according to the present invention.

Step 5. As shown in FIGS. 12 and 13, the prefabricated room module 10 is hoisted to a predetermined position on the $(N+1)^{th}$ floor, so that the penetrating rebars 2 protruding out of the top portion of the column 1 of the prefabricated room module 10 of the $N^{th}$ floor are inserted at the bottom of the inner chamber of the column 1 of the prefabricated room module 10 of the $(N+1)^{th}$ floor.

Figure 14:
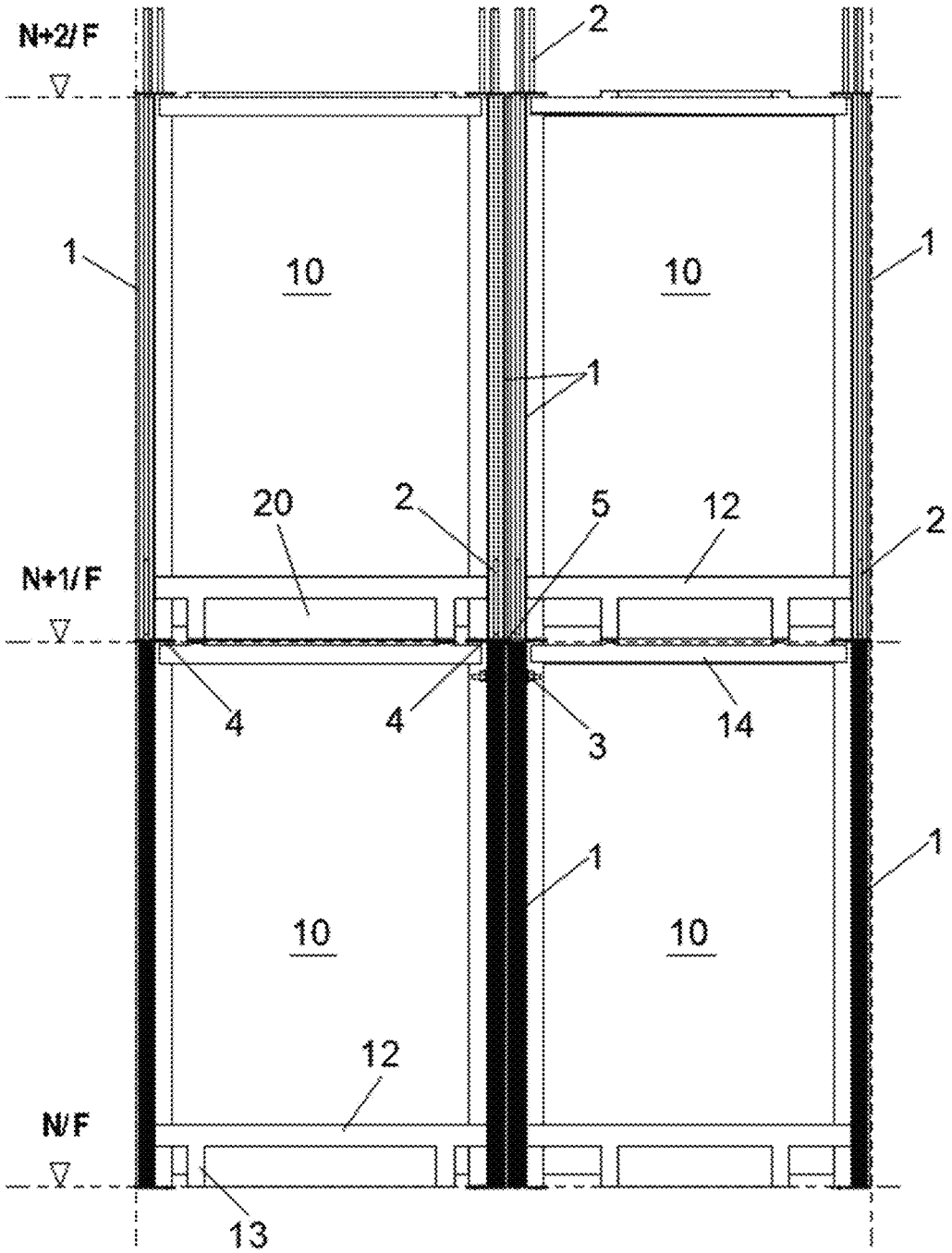
FIG. 14 schematically shows a vertical cross-sectional view for step 5 of the construction method for the integrated steel concrete building according to the present invention.
Figure 15:
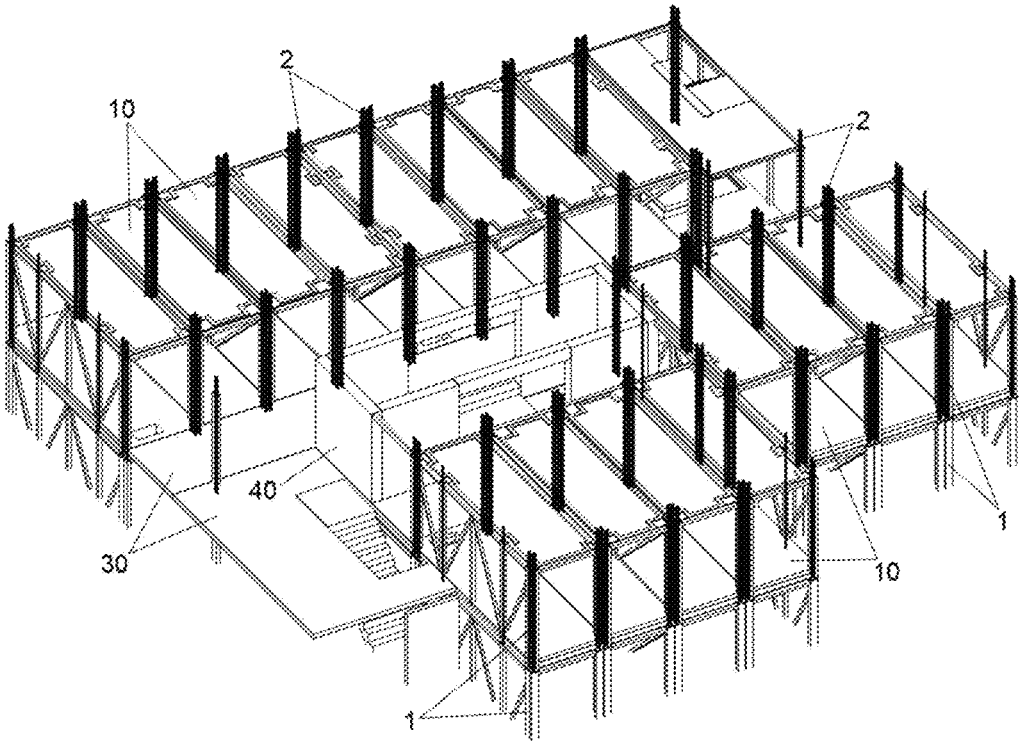
FIG. 15 schematically shows a perspective view for step 5 of the construction method for the integrated steel concrete building according to the present invention.

Step 6. As shown in FIGS. 14 and 15, the penetrating rebars 2 are entirely inserted into the inner chamber of the column 1 of the prefabricated room module 10 of the $(N+1)^{th}$ floor.

Figure 17:
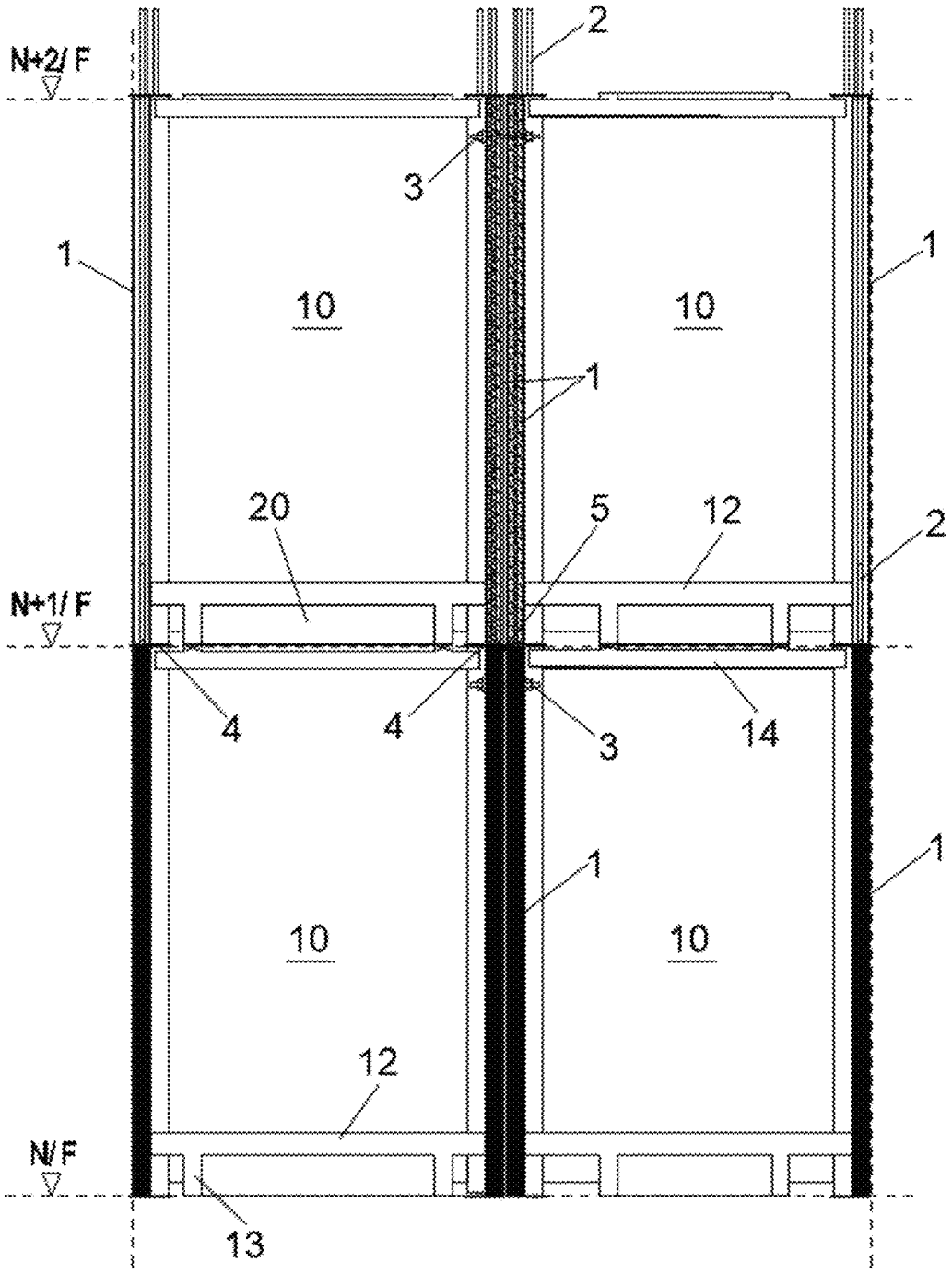
FIG. 17 schematically shows a vertical cross-sectional view for step 7 of the construction method for the integrated steel concrete building according to the present invention.

Step 7. As shown in FIG. 16, adjacent columns 1 of the adjacent prefabricated room modules 10 of the $(N+1)^{th}$ floor are connected with each other with penetrating bolts at the tops thereof;

Step 8. As shown in FIG. 17, cement mortar is poured into the inner chamber of the column 1 of the prefabricated room module 10 of the $(N+1)^{th}$ floor.

Figure 18:
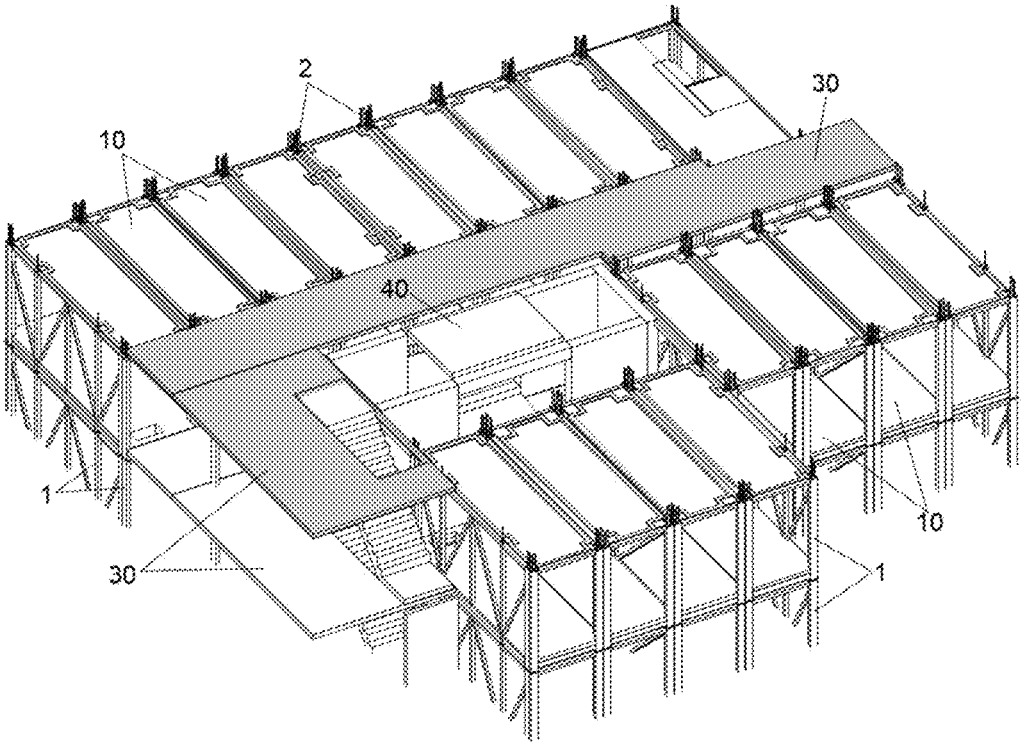
FIG. 18 schematically shows a perspective view for step 8 of the construction method for the integrated steel concrete building according to the present invention.

Step 9. As shown in FIG. 18, the prefabricated walkway plate 30 of an $(N+2)^{th}$ floor is placed.

Step 10. The above steps 1 to 9 are repeated, so as to complete the construction of an upper floor of the building.

It should be noted that the above construction method only illustrates the steps included in this embodiment, but does not define the order of the steps. The order of certain steps can be adjusted appropriately at the construction site according to actual needs.

The foregoing description is merely illustrative of preferred embodiments of the present invention, and is not intended to limit the present invention. Various changes and modifications may be made by those skilled in the art. Any modifications, equivalent substitutions, improvements, and the like within the spirit and principles of the present invention are intended to be included within the scope of the present invention.

The invention claimed is:

1. An integrated steel concrete building, comprising a plurality of prefabricated room modules of steel, wherein each prefabricated room module includes at least one column having a structure of hollow steel tube, which has an inner chamber inserted with penetrating rebars and poured with concrete, the penetrating rebars extending upwardly out of said column of said prefabricated room module into an inner chamber of a column of a respective prefabricated room module of an upper floor, wherein each prefabricated room module further includes a steel structure frame, a steel concrete top plate that is provided on its top surface with a boss extending upwardly, and a steel concrete bottom plate that is provided with a base beam extending downwardly, and wherein the boss is located in a position that the boss engages the base beam of the respective prefabricated room module of said upper floor so that a fireproof cavity is formed between two vertically adjacent prefabricated room modules.

2. The integrated steel concrete building according to claim 1, wherein adjacent columns of adjacent prefabricated room modules of a same floor are connected with each other through bolts at respective top portions of said adjacent columns.

3. The integrated steel concrete building according to claim 1, wherein the boss has a top, which engages a bottom of the base beam of the respective prefabricated room module of said upper floor, and wherein the fireproof cavity is defined by the steel concrete top plate of the each prefabricated room module and the steel concrete bottom plate of the respective prefabricated room module of the upper floor.

4. The integrated steel concrete building according to claim 1, wherein the boss has a top, a cushion layer is provided on the top and engages a bottom of the base beam of the respective prefabricated room module of said upper floor, and wherein the fireproof cavity is defined by the steel concrete top plate of the each prefabricated room module and the steel concrete bottom plate of the respective prefabricated room module of the upper floor.

5. The integrated steel concrete building according to claim 3, wherein each prefabricated room module further includes fireproof wall bodies.

6. The integrated steel concrete building according to claim 1, wherein a gasket is interposed between columns of two vertically adjacent prefabricated room modules, and is provided with through-holes, through which the penetrating rebars extend.

7. The integrated steel concrete building according to claim 1, wherein a top joint formed between two horizontally adjacent prefabricated room modules is filled with fireproof sealant.

8. The integrated steel concrete building according to claim 1, further comprising at least one prefabricated walkway plate and at least one cast-in-situ concrete structural member.

9. A construction method of the integrated steel concrete building according to claim 1, including:

step A, hoisting, after an $N^{th}$ floor of the building is completed, the prefabricated room module to a predetermined position on an $(N+1)^{th}$ floor;

step B, inserting the penetrating rebars protruding out of the top portion of the column of the prefabricated room module of the $N^{th}$ floor into the inner chamber of the column of the prefabricated room module of the $(N+1)^{th}$ floor;

step C, connecting adjacent columns of adjacent prefabricated room modules of the $(N+1)^{th}$ floor with each other through bolts at the top portions thereof; and step D, pouring cement mortar in the inner chamber of the column of the prefabricated room module (10) of the $(N+1)^{th}$ floor.

10. The construction method of the integrated steel concrete building according to claim 9, further comprising, before step A, step A1 of forming a cast-in-situ concrete structure on the $(N+1)^{th}$ floor.

11. The construction method of the integrated steel concrete building according to claim 9, further comprising, before step A, step A2 of filling fireproof sealant in a top joint between two adjacent prefabricated room modules of the $N^{th}$ floor.

12. The construction method of the integrated steel concrete building according to claim 9, further comprising, before step A, step A3 of placing a gasket on the top portion of the column of the prefabricated room module of the $N^{th}$ floor, and step A4 of providing a cement mortar cushion layer at a periphery of the top portion of the prefabricated room module of the $N^{th}$ floor.

13. The construction method of the integrated steel concrete building according to claim 9, further comprising, after step D, step E of placing a prefabricated walkway plate of an $(N+2)^{th}$ floor.

* * * * *